US005145005A

United States Patent [19]

Dollison

[11] Patent Number: 5,145,005

[45] Date of Patent: Sep. 8, 1992

[54] CASING SHUT-IN VALVE SYSTEM

[75] Inventor: William W. Dollison, Dallas, Tex.

[73] Assignee: Otis Engineering Corporation, Carrollton, Tex.

[21] Appl. No.: 692,193

[22] Filed: Apr. 26, 1991

[51] Int. Cl.[5] ..... E21B 34/14; E21B 34/12

[52] U.S. Cl. ..... 166/334; 137/527; 166/242; 166/323; 166/332; 175/318; 251/303

[58] Field of Search ..... 166/332, 334, 318, 386, 166/325, 327, 321, 237, 238, 330, 242, 323; 137/527, 527.6, 527.4; 251/303, 298, 149.2; 175/318

[56] References Cited

U.S. PATENT DOCUMENTS

| | | | |
|---|---|---|---|
| 1,710,410 | 4/1929 | Defenbaugh | 137/527.6 X |
| 1,871,536 | 8/1932 | Le Bus | 137/527 X |
| 2,162,578 | 6/1939 | Hacker | 175/318 X |
| 2,202,192 | 5/1940 | Cypher | 166/84 X |
| 2,354,310 | 7/1944 | Goodwin | 166/334 X |
| 2,447,842 | 8/1948 | Cameron et al. | 137/152 |
| 3,071,193 | 1/1963 | Raulins | 166/332 |
| 3,414,060 | 12/1968 | Zak | 166/332 X |
| 3,672,630 | 6/1972 | Naumburg et al. | 251/303 X |
| 4,531,587 | 7/1985 | Fineberg | 166/332 |
| 4,706,933 | 11/1987 | Sukup et al. | 251/54 |
| 4,926,945 | 5/1990 | Pringle et al. | 166/321 |
| 4,928,772 | 5/1990 | Hopmann | 166/386 |
| 4,977,957 | 12/1990 | Pringle | 166/321 |
| 5,044,396 | 9/1991 | Daudet et al. | 137/527.6 X |

OTHER PUBLICATIONS

"A New Technique for Servicing Horizontal Wells", Tailby et al., SPE 22823, Oct. 1991.

"New Life From Old Oil Wells" appeared in *Mechanical Engineering*, Feb. 1991, pp. 37–41.

*Primary Examiner*—Hoang C. Dang

*Attorney, Agent, or Firm*—Ross, Howison, Clapp & Korn

[57] ABSTRACT

A casing shut-in valve system (74) having a flapper valve assembly (34) and a shift head assembly (76); the flapper valve assembly (34) having an upper body member (36), lower body member (38), flow sleeve (40), valve seat sleeve member (42), flapper (54), flapper hinge assembly (56), and a plurality of spring strut assemblies (58) disposed on opposite sides of the flapper hinge assembly; the shift head assembly (76) having key housing (134) with bit sub (144) rotatably mounted in bearing (152), a plurality of outwardly biased shift keys (80), and a load equalizer plate (138) at each end of the key housing; the shift head assembly (76) being adapted to selectively open or close the valve by engaging and moving the flow sleeve (40) between defined upper and lower positions, thereby controlling the movement of flapper (54) through an angle (128) of rotation that is less than 90 degrees, and preferably about 45 degrees.

21 Claims, 8 Drawing Sheets

CASING SHUT-IN VALVE SYSTEM

BACKGROUND OF THE INVENTION

1. Field of the Invention

This invention relates to a downhole valve system, and in its preferred embodiment, to a well casing shut-in valve system. The preferred valve system of the invention relates to a downhole flapper valve assembly useful for controlling the flow of hydrocarbons and drilling fluids upwardly through a well casing whenever the drill string is tripped during drilling, and a shift head assembly adapted to engage a flow sleeve within the subject flapper valve assembly to selectively open and close the flapper valve.

2. Description of the Prior Art

During well drilling operations, the drill string is frequently tripped from the well for bit or motor replacement. Problems can arise during tripping if hydrocarbon fluids from downhole formations overpressure the drilling fluid in the well bore. Such problems are particularly likely to occur in highly deviated wells, including but not limited to so-called "horizontal drilling" operations in which the well bore descends vertically to a desired kick-off point, and then veers off horizontally through numerous vertical fractures. When it becomes necessary to come out of the hole and the bottom hole assembly is drawn up into the vertical casing, the well may begin to produce.

One technique previously used to control the upward flow of hydrocarbon fluids when wells become underbalanced during tripping has been to seal off the well bore at the wellhead and to condition the drilling mud by increasing its weight sufficiently to overpressure the hydrocarbon flow. As the drill string is withdrawn to shallower depths, this mud conditioning procedure may have to be repeated several times, progressively increasing the weight of the mud and also increasing costs. To avoid the need for repeatedly reconditioning the drilling fluid during tripping, a valve assembly can be installed downhole to serve as a check valve on the upward flow of hydrocarbon fluids.

The use of flapper valves as check valves or safety valves in subterranean wells has previously been disclosed, for example, in U.S. Pat. Nos. 2,447,842; 4,531,587; 4,706,933; 4,926,945 and 4,977,957.

U.S. Pat. No. 2,447,842 discloses the use of a flapper valve as a back-pressure check valve inside the drill stem, preferably near the bottom of the stem just behind the drill collar of the bit. The actuating member of the valve is a tubular piston with a flared head that moves upwardly under back-pressure from within the well to close the flapper upon withdrawal of a tool string.

U.S. Pat. No. 4,531,587 discloses a downhole flapper valve and actuator in which the downwardly facing surfaces of the actuating sleeve are shaped to cooperate with the upwardly facing cylindrical segment surfaces of the flapper valve body so that the effective point of application of the downward force produced by the actuating sleeve has a roughly equivalent moment arm as the resultant upward force produced by downhole fluid pressure. This construction is said to minimize any torsional moment being applied to the flapper which must be absorbed by the hinge pin. A pair of helical springs apply a torsional bias to the ends of integral hinge pins to urge the flapper valve to its closed position.

U.S. Pat. No. 4,706,933 discloses a flapper valve having a control link attached to the flapper at a centralized point removed from the hinge. The control structure comprises a hydraulically actuated piston moveable in a valve control cylinder. The piston is biased by a compression spring in the direction of the valve. A damping structure is provided to control the movement of the piston in its cylinder.

U.S. Pat. No. 4,926,945 discloses a subsurface well safety valve having a curved flapper with a concave surface which forms a sealing surface with a valve seat having a coacting contoured seating surface A flow tube is telescopically moveable in the housing for controlling the movement of the valve closure member, and the lower end of the flow tube is a cylindrical surface having a radius substantially equal to the radius of the concave sealing surface. Hydraulic piston and cylinder means are provided in the housing for actuating the flow tube.

U.S. Pat. No. 4,977,957 discloses a subsurface well safety valve having a flapper valve, a telescopically moveable, lightweight flow tube for controlling the movement of the valve closure member, and a hydraulic piston and cylinder means for actuating the flow tube.

The flapper valves in each of the prior art patents disclosed above opens and closes by rotating through an angle of 90 degrees. The large differential pressures and high fluid velocities sometimes encountered during use of such valves in downhole applications can cause stress concentrations leading to valve failure due to broken springs, hinges, or the like. Others have previously sought to reduce the likelihood of such failures by using control pistons in combination with compression springs or hydraulic cylinders to dampen the forces exerted against flappers and their hinge points, or by constructing valve parts from lighter weight materials.

SUMMARY OF THE INVENTION

According to the present invention, a downhole valve assembly is provided that reduces stresses on valve components by utilizing a curved flapper which moves from a fully open position to a fully closed position by rotating through an angle that is less than 90, and most preferably, about 45 degrees.

The valve assembly of the invention preferably comprises a flapper valve assembly having a valve body, a tubular valve seat with a curved seating surface, a curved flapper with an elastomeric seal adapted to engage the curved seating surface of the valve seat, a rotatable hinge assembly that secures the flapper to the valve body, spring strut assemblies disposed opposite the hinge assembly that are adapted to cause the flapper to rotate into sealing engagement with the valve seat when the valve is closed, and a longitudinally slidable flow sleeve assembly adapted for use in selectively opening or closing the valve.

The casing shut-in valve system of the invention preferably further comprises a shift head assembly adapted to releasably engage the flow sleeve to selectively open or close the valve. The shift head assembly preferably comprises a key housing having plurality of circumferentially spaced, spring-loaded shift keys that are biased radially outward to engage annular recesses in the interior wall of the flow sleeve for use in opening and closing the valve. The subject shift head assembly preferably further comprises a load equalizer plate and large cross-section O-ring at each end of the key housing to distribute the mechanical load substantially equally to each circumferentially spaced key. A bit sub, rotatably mounted in a Cutless® bearing, provides a flow channel for drilling fluid through the shift head assembly. The load equalizer plates are particularly useful where the hole is drilled using a bent sub having, for example, a ¾ degree offset.

BRIEF DESCRIPTION OF THE DRAWINGS

The apparatus of the invention is further described and explained in relation to the following figures of the drawings in which.

Like reference numerals are used to indicate like parts in all figures of the drawings.

DESCRIPTION OF THE PREFERRED EMBODIMENTS

Figure 1:
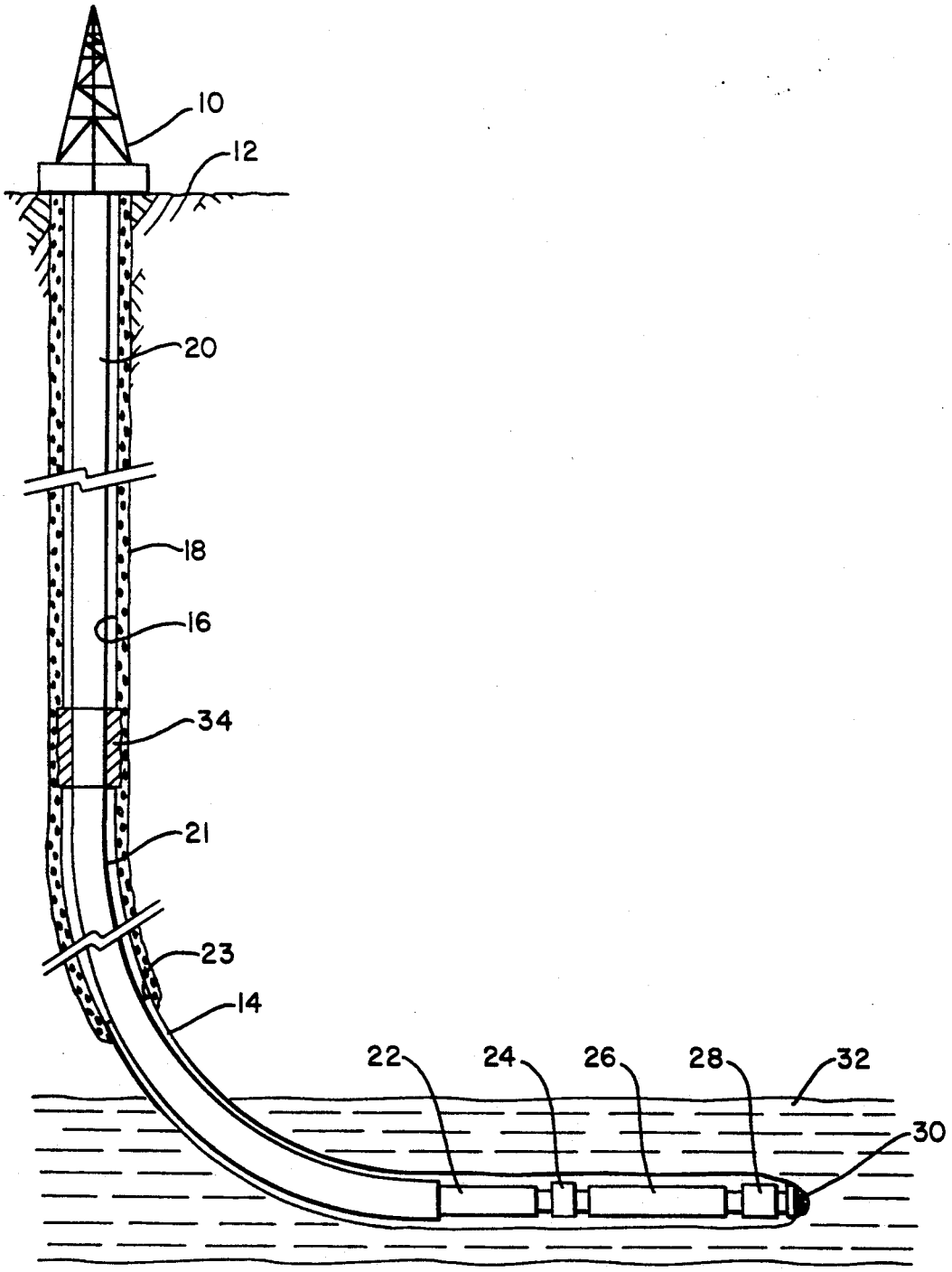
FIG. 1 is a schematic elevation view, partially in section, depicting a drilling rig installed over a well bore in which the casing shut-in valve system of the invention is deployed downhole, and in which the drill string is directed horizontally into a subterranean stratum from a kick-off point below the subject valve.

Referring to FIG. 1, drilling rig 10 is positioned at ground surface 12 over well bore 14. Casing 16 is fixed by cement 18 inside well bore 14, and normally extends 300 to 400 feet below kick-off point 21, where the inclination of well bore 14 begins to deviate from substantially vertical, as might occur during horizontal drilling or in a highly deviated well. Drill string 20 extends downwardly through casing 16 from drilling rig 10, beyond casing end 23, and into the section of well bore 14 that lies horizontally in stratum 32. At the distal end of drill string 20 is a bottom hole assembly that typically comprises MWD (measuring while drilling) equipment 22, stabilizer 24, mud motor 26, shift head 28 and drill bit 30. Flapper valve assembly 34 of the invention is preferably cemented into well bore 14 together with casing 16, and drill string 20 passes through flapper valve assembly 34 as it enters or leaves the hole. According to a particularly preferred embodiment of the invention, flapper valve assembly 34 is installed in casing 34 about 100 hundred feet above kick-off point 21.

Figure 2:
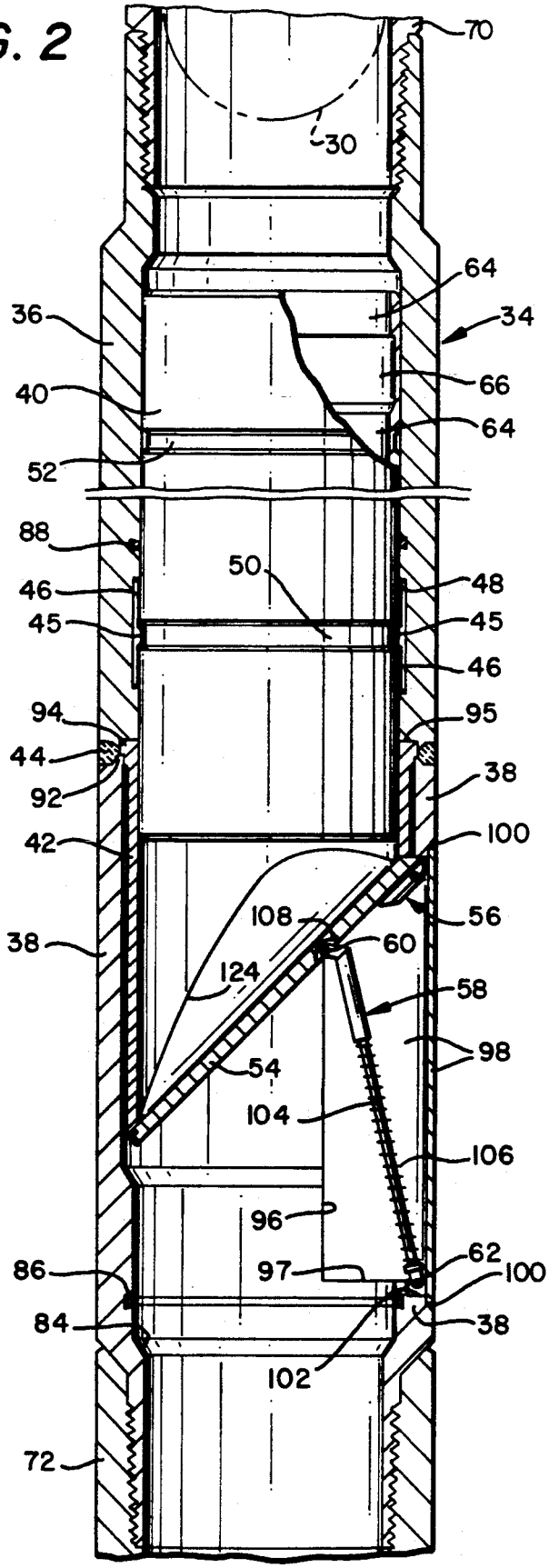
FIG. 2 is an elevation view, partially in section and partially broken away, of the flapper valve assembly of the invention, showing the flow sleeve in its upper position and the flapper valve closed, the condition that exists whenever the drill string is drawn upwardly to a point where the bottom hole assembly is above the flapper valve assembly.
Figure 3:
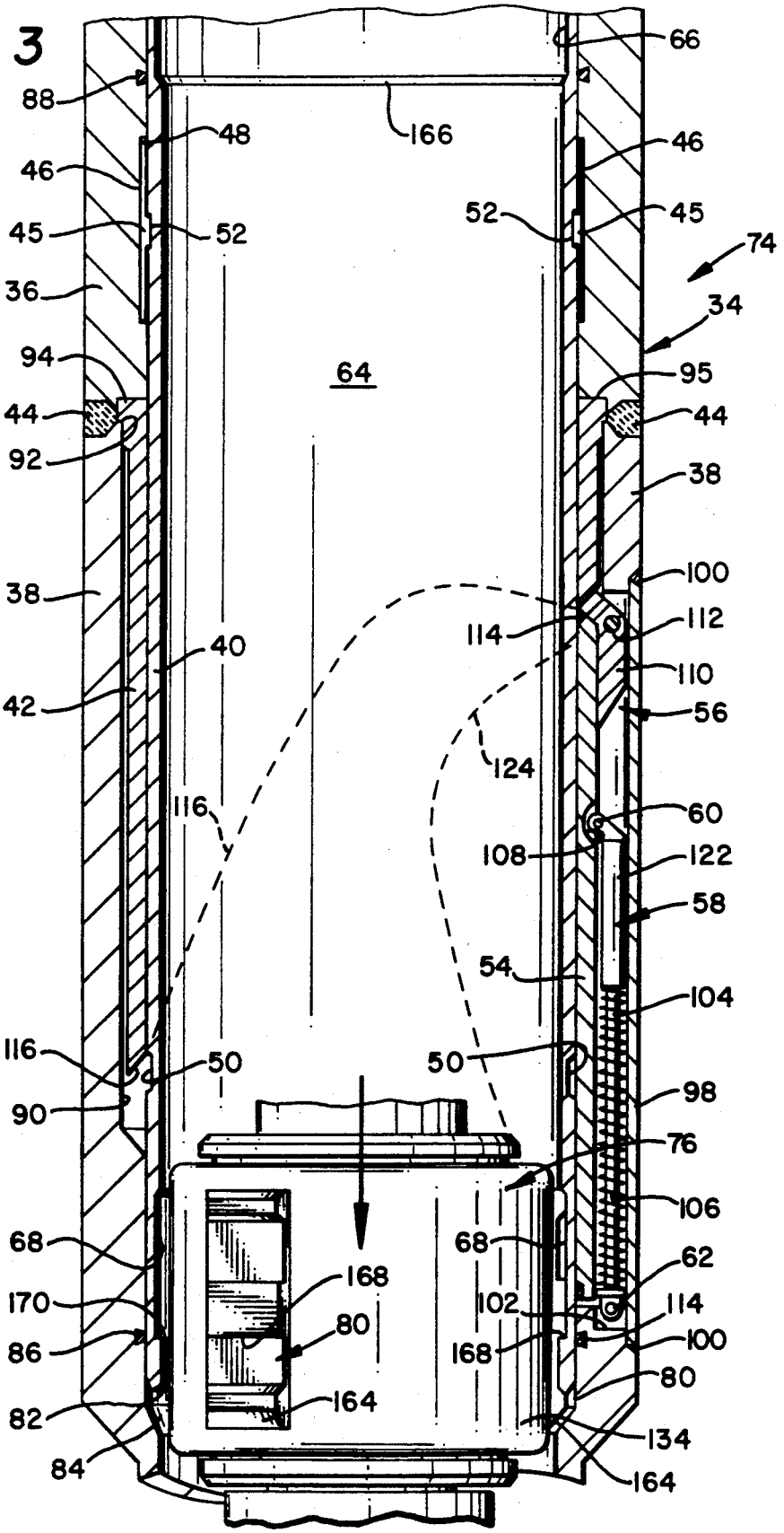
FIG. 3 is an enlarged elevation view, partially in section, of the casing shut-in valve system of the invention in which the shift head has engaged the flow sleeve and driven it downwardly to open the flapper during insertion of the drill string through the flapper valve assembly.

Referring to FIGS. 2 and 3, flapper valve assembly 34 preferably comprises as its primary structural elements upper body member 36, lower body member 38, flow sleeve 40, valve seat sleeve member 42, flapper 54, flapper hinge assembly 56, and spring strut assemblies 58. Upper body member 36 and lower body member 38 are preferably made of tubular steel, and are connected to each other by weld 44, although it is understood that a threaded connection can be used instead of the weld if desired. As shown in FIG. 2, upper body member 36 is threaded onto casing section 70, and casing section 72 is threaded onto lower body member 38. For ease of illustration, the well bore and cement are not shown except in FIG. 1.

Flapper valve assembly 34 is preferably run into a well in its fully open position, with flow sleeve 40 and flapper 54 in the positions shown in FIG. 3 so that cement will not contaminate, foul or otherwise restrict operation of the valve. Lower and upper O-rings 86, 88, respectively, prevent cement from penetrating into the annular space between flow sleeve 40 and upper and lower body members 36, 38 as cement is pumped down casing 16 so that it can circulate back up the annulus between the outside wall of casing 16 and well bore 14. After casing 16 is cemented, it is desirable to wash out the casing, or if necessary, run a scratcher or scraper down through the casing and flow sleeve 40 to insure that upper and lower annular recesses 66, 68, respectively, are clear and available for engagement with shift keys 80 of shift head assembly 76 as described below in relation to FIGS. 3 and 4.

Flow sleeve 40 is substantially cylindrical, and has an outside diameter slightly less than the inside diameter of upper body section 36 to facilitate longitudinal sliding engagement therebetween. Inside surface 64 of flow sleeve 40 preferably comprises upper and lower annular recesses 66, 68, respectively. Upper annular recess 66 is visible in FIGS. 2 and 3, and lower annular recess 68 is visible in FIGS. 3 and 4. The outside surface of flow sleeve 40 preferably comprises annular lower detent groove 50 and upper detent groove 52, which are adapted to receive detent members 45 of bow spring 46 disposed in annular recess 48 on the inside wall of upper body member 36. As shown in FIG. 2, flow sleeve 40 is maintained in its uppermost position in flapper valve assembly 34 whenever detent member 45 of bow spring 46 is engaged in lower detent groove 50. Flow sleeve 40 is inserted into flapper valve assembly 34 prior to connecting upper body member 36 to lower body member 38.

Valve seat sleeve member 42 is likewise preferably inserted concentrically into flapper valve assembly 34 prior to assembling upper body member 36 and lower body member 38. Valve seat sleeve member 42 preferably comprises outwardly extending flange 94 that engages and is supported by annular shoulder 92 of lower body member 38. When upper and lower body members 36, 38 are joined by weld 44, valve seat sleeve member 42 is locked into position between annular shoulder 92 and abutting annular shoulder 95 at the lower end of upper body member 36. Although the inside surface of valve seat sleeve member 42 is generally cylindrical, its lower edge presents a constant radius arcuate seating surface 116 generated at an angle less than 90 degrees, and preferably at an angle of about 45 degrees, with the center line of flapper valve assembly 34. Flow sleeve 40 is adapted to slide longitudinally inside valve seat sleeve member 42. The inside diameter of flow sleeve 40 is slightly greater than the outside diameter of drill string 20, including any element of the bottom hole assembly, so that drill string 20 can pass through flapper valve assembly 34.

Flapper 54, the valve closure member, is a section of a cylinder that has an inside radius identical to that of valve seat sleeve member 42 and an arcuate sealing edge 124 that is adapted to engage and seal against seating surface 116. According to a preferred embodiment of the present invention, valve seat sleeve member 42 and flapper 54 are designed and constructed so that sealing edge 124 fully engages seating surface 116 after flapper 54 has rotated about 45 degrees from its fully open position, as is discussed in more detail in relation to FIG. 4A below. Because flapper 54 is a cylindrical section, it can be hidden behind flow sleeve 40 when in the open position as shown in FIG. 3, but can be rotated to the fully closed position shown in FIGS. 2 and 4A without interfering with the inside wall of lower body member 38.

Figure 4:
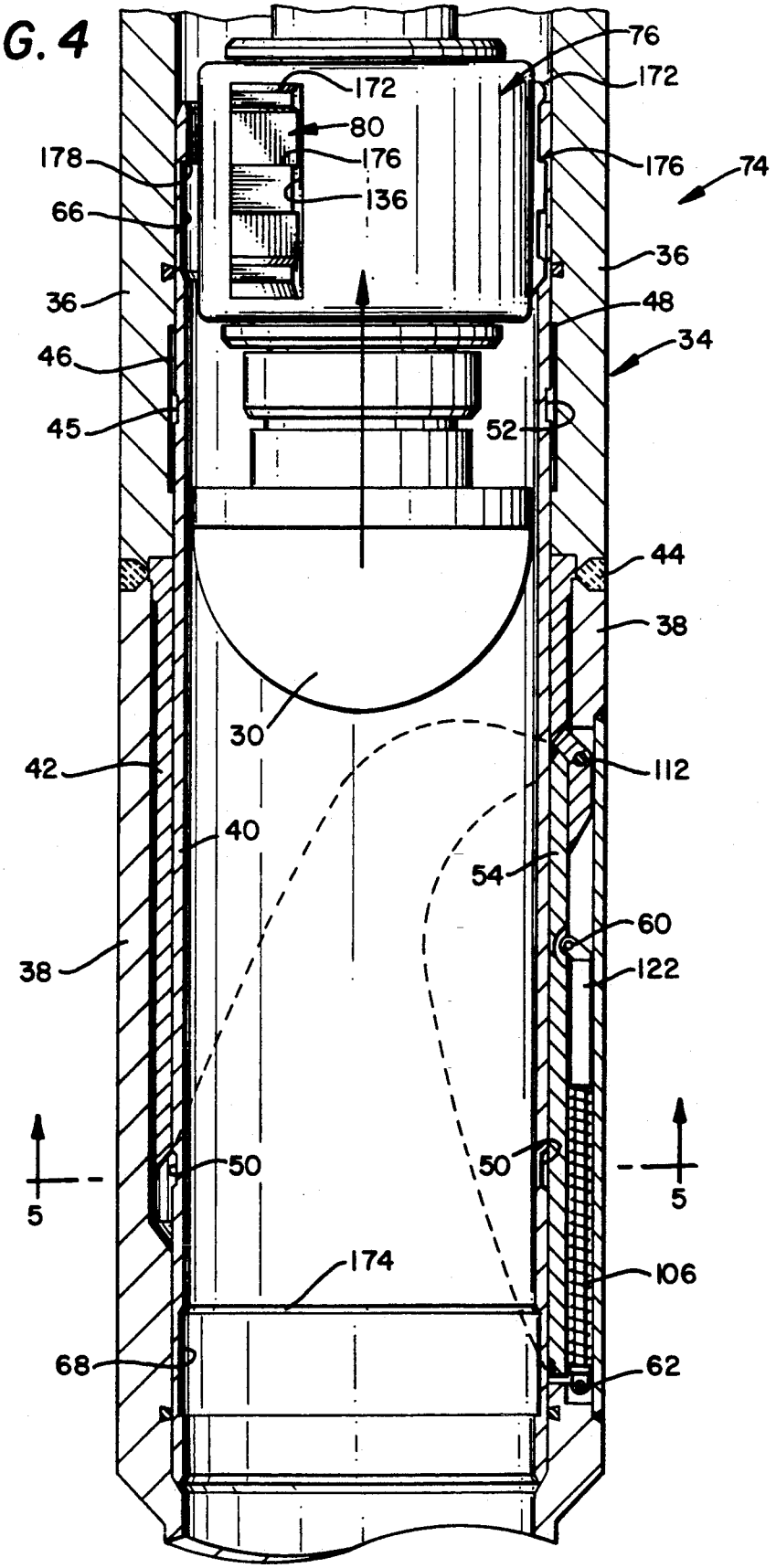
FIG. 4 is an enlarged elevation view, partially in section, of the casing shut-in valve system of the invention in which the shift head has engaged the flow sleeve while being withdrawn upwardly through the flapper valve assembly, just prior to overpressuring the detent member out of the upper detent groove to permit the flow sleeve to be drawn upwardly by the shift head so that the flapper can close.
Figure 4A:
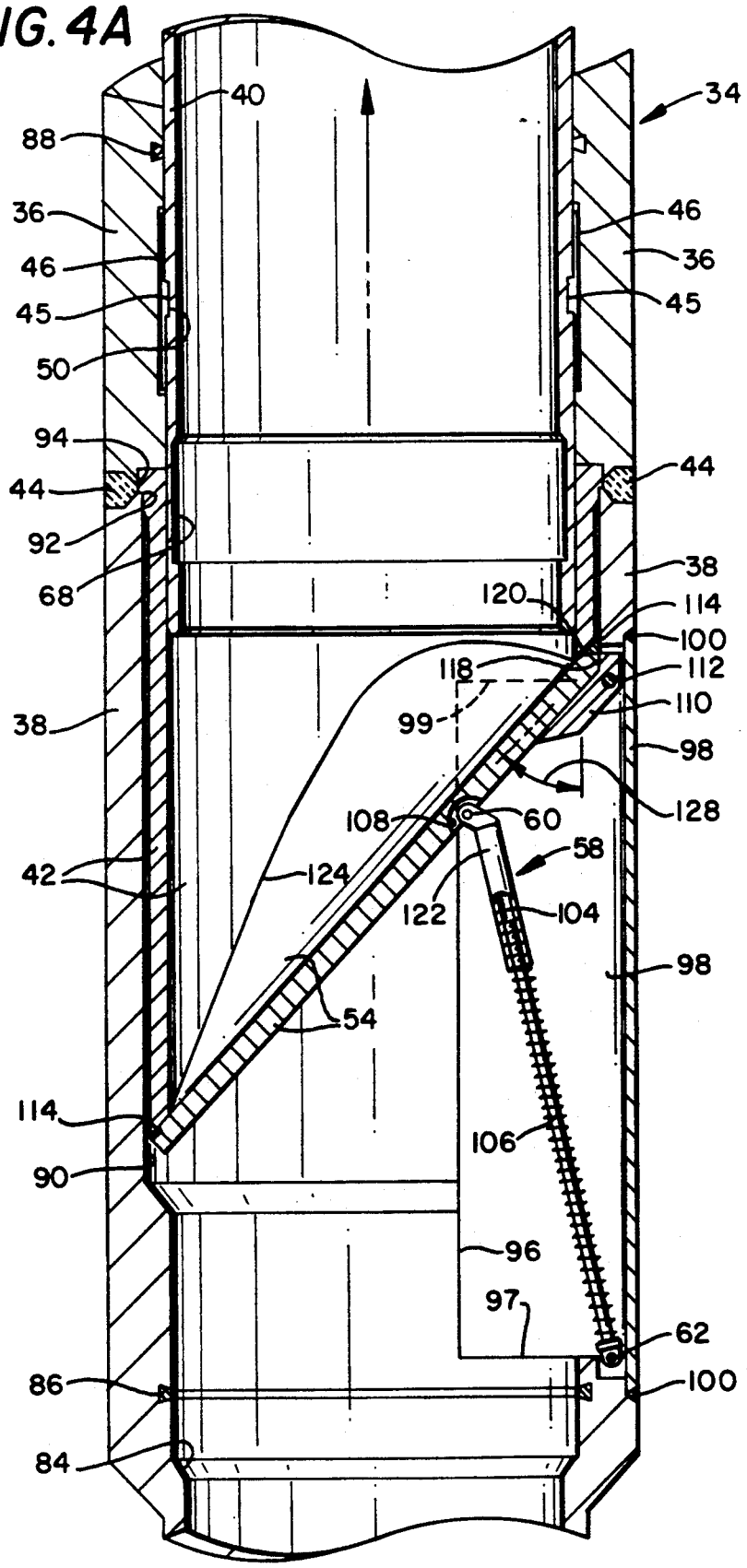
FIG. 4A is an enlarged elevation view, partially in section, showing the flapper valve assembly of the invention after the flow sleeve has been pulled upwardly a sufficient distance that the bow spring detent member has engaged the lower detent groove and the flapper has closed, thereby blocking the flow of fluids toward the surface.
Figure 5:
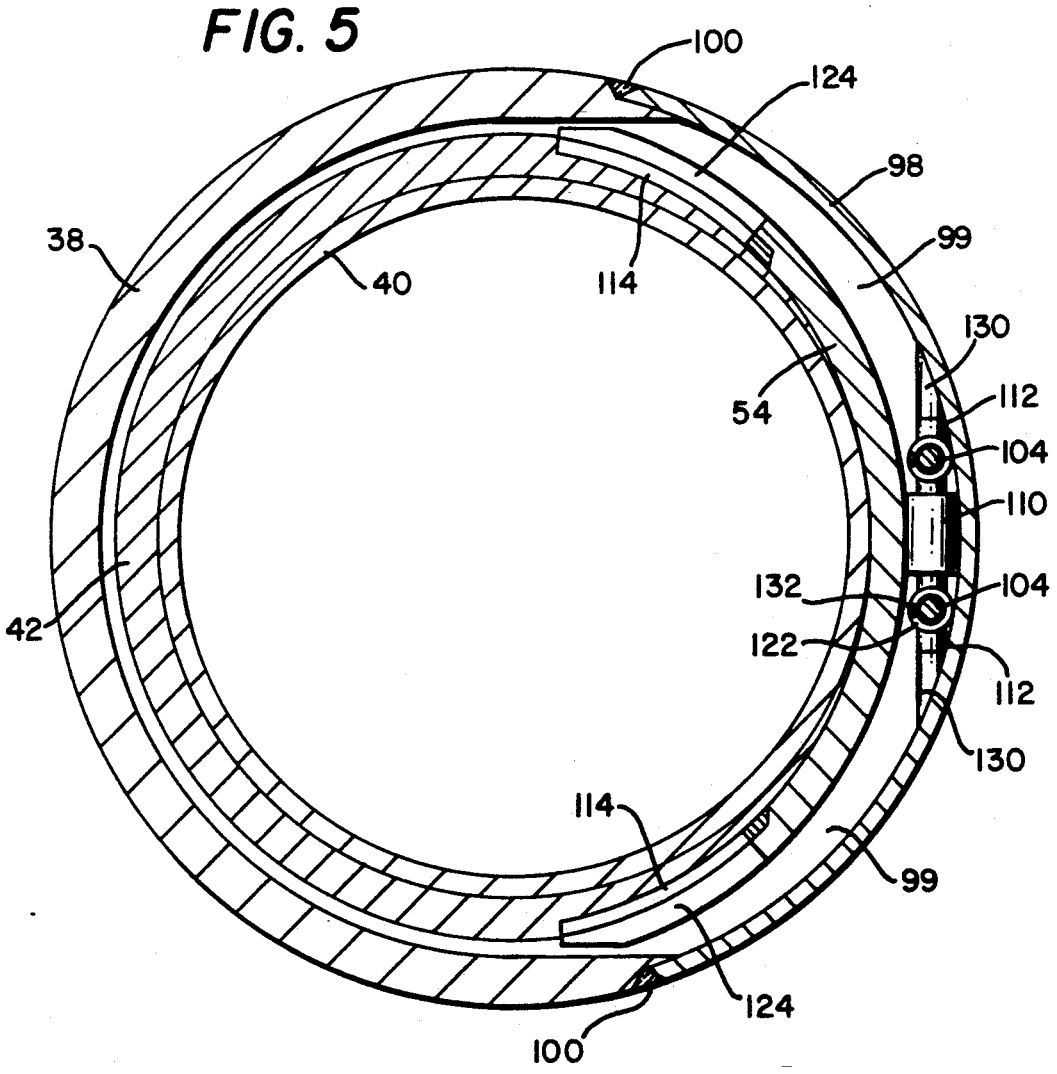
FIG. 5 is a cross-sectional view taken along line 5—5 of FIG. 4 through the flapper valve assembly of the invention.

Flapper 54 is preferably installed inside flapper valve assembly 34 through a window in lower body member 38 that is defined by vertical edges 96 (one of which is not visible in the longitudinal section shown in FIGS. 2 and 4A), arcuate bottom edge 97, and arcuate top edge 99 (visible in FIG. 5 and shown as a hidden line in FIG. 4A). Arcuate window cover 98 is preferably attached to lower body member 38 by means such as peripherally extending weld 100 after flapper 54 is inserted through the window, and after and flapper hinge assembly 56 and spring strut assemblies 58 are connected to lower body member 38. Although only one spring strut assembly 58 is visible in FIG. 2, flapper valve assembly 34 of the invention preferably comprises a plurality of spring strut assemblies 58, with at least one spring strut assembly 58 being disposed on each side of hinge assembly 56.

The structure and installation of flapper 54, flapper hinge assembly 56 and spring strut assemblies 58 are further described and explained in relation to FIGS. 3, 4, 4A and 5, enlarged views in which they are more clearly visible. Flapper hinge assembly 56 preferably further comprises hinge member 110 and hinge pin 112. Hinge member 110 is preferably secured in fixed relation to the upper, outwardly facing surface of flapper 54 at the midpoint of the circumferentially extending arc defined by flapper 54, as seen in FIG. 5. Hinge member 110 is preferably rotatably mounted on transversely extending hinge pin 112, and hinge pin 112 is connected in fixed relation to lower body member 38 at a point offset radially outward from the longitudinal axis through the longest section of flapper 54 as shown in FIG. 3. According to a particularly preferred embodiment of the invention, best seen in FIG. 5, hinge pin 112 is welded into a semi-circular saddle in the face of arcuate top edge 99 of the window in lower body member 38. Elastomeric seal 114 is preferably molded around sealing edge 124 of flapper 54 to promote a fluid-tight sealing between flapper 54 and valve seat sleeve member 42 whenever flapper valve assembly 34 is rotated to the closed position.

Spring strut assemblies 58 each preferably comprise upper hinge 60, lower hinge 62, guide member 104, strut spring 106 and hinge support member 122. Each upper hinge 60 rotatably connects a spring strut assembly 58 to flapper 54 at a point that is spaced downwardly from hinge member 110. Strut spring 106 biases flapper 54 toward the closed position. By distancing the upper hinge 60 longitudinally from hinge pin 112, the spring force required to start moving a closure member such as flapper 54 from the open to closed position is reduced. The use of a plurality of spring strut assemblies 58, preferably two, circumferentially spaced an equal distance on each side of hinge member 110, also reduces the stress on flapper hinge assembly 56. Arcuate recess 108 is preferably provided on the outwardly facing side of flapper 54 to facilitate the rotation of flapper 54 relative to upper hinge 60 between the open position of FIGS. 3 and 4 and the closed position shown in FIG.ure 4A. Hinge support member 122 is preferably angled so that upper hinge 60 is disposed radially inward relative to both hinge pin 112 and lower hinge 62. This spacing provides a positive moment that enables strut spring 106 to act through hinge support member 122 on upper hinge 60 to begin forcing flapper 54 radially inward once flow sleeve 40 is retracted upwardly above hinge point 112. This spacing also allows guide member 104 to rotate into the annular space between flapper 54 and window cover 98 when flapper 54 is forced open by the downward motion of flow sleeve 40 as described below in relation to FIG.ure 3, compressing strut spring 106. Recess 102 is preferably provided in lower body portion 38 to accommodate the rotational motion of guide member 104 around lower hinge 62.

Figure 8:
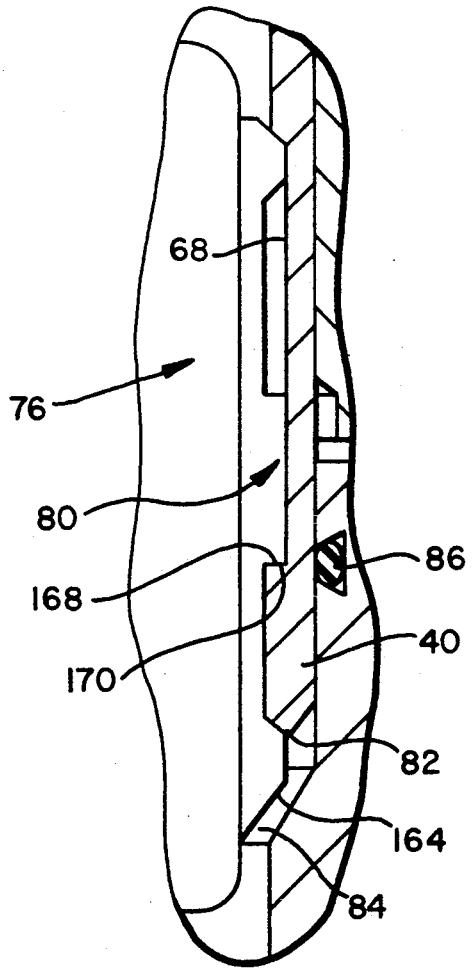
FIG. 8 is an enlarged detail view, partially in section, depicting the engagement of a shift key with the lower annular recess of the locking sleeve as shown in FIG. 3.

Referring to FIG. 3, casing shut-in valve system 74 of the invention preferably comprises flapper valve assembly 34 and means such as shift head assembly 76 for controlling the movement of flow sleeve 40 between the upper position shown in FIG. 2 and the lower position shown in FIG. 3. As shift head assembly 76 is run into the well, shift keys 80, which are biased radially outward, first engage upper annular recess 66 of flow sleeve 40 while flow sleeve 40 is locked in the upper position as shown in FIG. 2. When beveled surface 164 of shift keys 80 engages beveled surface 166 of upper annular recess 66, outwardly biased shift keys 80 are cammed out of upper annular recess 66 and pushed back into windows 136, and shift head assembly 76 continues traveling downwardly through flow sleeve 40. When shift head assembly 76 reaches the bottom of part of flow sleeve 40, shift keys 80 engage lower annular recess 68. As shown in more detail in FIG. 8, square shoulder 168 of shift keys 80 engages and abuts against square shoulder 170 of lower annular recess 68, stopping the downward travel of shift head assembly 76 through flapper valve assembly 34.

Once shift keys 80 are engaged in lower annular recess 68 of flow sleeve 40, sufficient downward force is exerted on shift head assembly 76 through drill string 20 that bow spring 46 is overpressured, causing detent member 45 to disengage from lower detent groove 50. According to a preferred embodiment of the invention, the restraining load on detent members 45 and bow spring 46 is at least about 10,000 pounds. Because of the heavy weight of drill string 20 hanging from the hook of drilling rig 10, a high order detent is required so that personnel at the surface can recognize when shift head assembly 76 has engaged flow sleeve 40.

Once detent members 45 have disengaged from lower detent groove 50, flow sleeve is pushed downwardly by shift head assembly 76 until detent members 45 again engage upper detent groove 52 as shown in FIG. 3. When flow sleeve 40 reaches this position, bottom edge 82 is spaced slightly apart from beveled annular shoulder 84 of lower body member 38, but beveled shoulder 164 of shift keys 80 contacts and slides against beveled shoulder 84 of lower body member 38 to cam outwardly biased shift keys 80 out of lower annular recess 68 and back into windows 136.

As drill bit 30 precedes shift head assembly 76 downward through flapper valve assembly 34, drill bit 30 contacts flapper 54, rotating flapper 54 from the position shown in FIG. 2 toward the position in which it is shown in FIG. 3. As flow sleeve 40 is pushed far enough down through valve seat sleeve member that bottom edge 82 contacts flapper 54, flapper 54 is rotated downwardly about 45 degrees into substantially parallel alignment with flow sleeve 40 in the annular space between flow sleeve 40 and window cover 98. As flapper 54 rotates from its closed position into its open position, strut spring 106 is compressed, preparing spring strut assemblies 58 to rotate flapper 54 inwardly again when flow sleeve 40 is returned to its upper position.

The closing of flapper valve assembly 34, as is desirable during tripping to prevent hydrocarbon fluids downhole from overpressuring the drilling mud when the well is underbalanced, is described in relation to FIGS. 4 and 4A. As the bottom hole assembly of drill string 20 is withdrawn upwardly through flapper valve assembly 34, shift keys 80 of shift head assembly first engage lower annular recess 68 of flow sleeve 40. As beveled surface 172 of shift keys 80 contacts and slides against beveled surface 174 of lower annular recess 68, outwardly biased shift keys 80 are cammed out of lower annular recess 68 and pushed back into windows 136. Shift head assembly 76 then travels upwardly through flow sleeve 40 until shift keys 80 engage upper annular recess 66 as shown in FIG. 4. When square shoulder 176 of shift keys 80 engages square shoulder 178 of upper annular recess 66, the upward movement of shift head assembly 76 is stopped until the upward force exerted on shift head assembly 76 through drill string 20 overpressures bow spring 46, causing detent members 45 to snap out of upper detent groove 52.

Once detent members 45 disengage from upper detent groove 52, shift head assembly 76 forces flow sleeve 40 upwardly to the point where detent members 45 of bow spring 46 engage lower detent groove 50 of flow sleeve 40 as shown in FIG. 4A. Referring to FIG. 4A, as flow sleeve 40 moves up, flapper 54 is rotated through a preferred angle 128 of about 45 degrees from the fully open position to the fully closed position. This rotation is initiated by the action of strut spring 106 on hinge support member 122, which causes hinge 60 to rotate away from window cover 98. Once flapper 54 begins to traverse the bore of lower body member 38, the fluid pressure differential across flapper valve assembly 34 causes sealing edge 124 of flapper 54 to fully seat itself against seating surface 116 of valve seat sleeve member 42. Shut-in pressure exerted on flapper 54 from downhole squeezes elastomeric seal 114 against seating surface 116, thereby improving the seal.

Because the preferred angle of rotation is only about 45 degrees, as compared to the 90 degrees of rotation experienced with conventional flapper valve assemblies, flapper 54 gathers less momentum and less stress is exerted on hinge member 110 and hinge pin 112 when flapper 54 closes. Because of the high pressures that may be exerted on flapper 54 from downhole once flapper 54 begins to close, the smaller angle of rotation and the shorter distance of travel for flapper 54 achieved through use of the invention disclosed herein should minimize the slamming effect on flapper 54 and valve seat sleeve member 42. This will in turn result in fewer instances of flapper valve failure, and will prolong the life of elastomeric seal 114.

Figure 7:
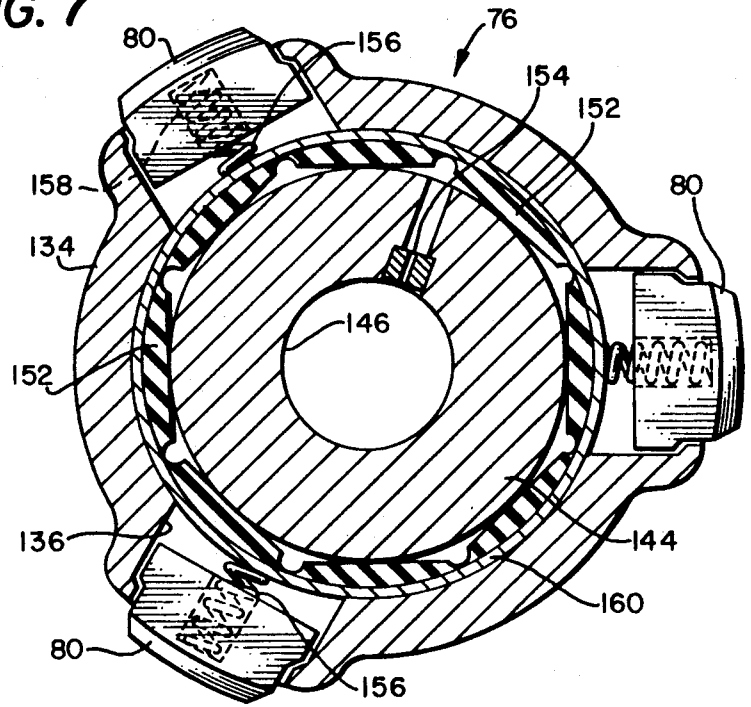
FIG. 7 is a cross-sectional view taken along line 7—7 of FIG. 6 through the shift head assembly of the invention.
Figure 6:
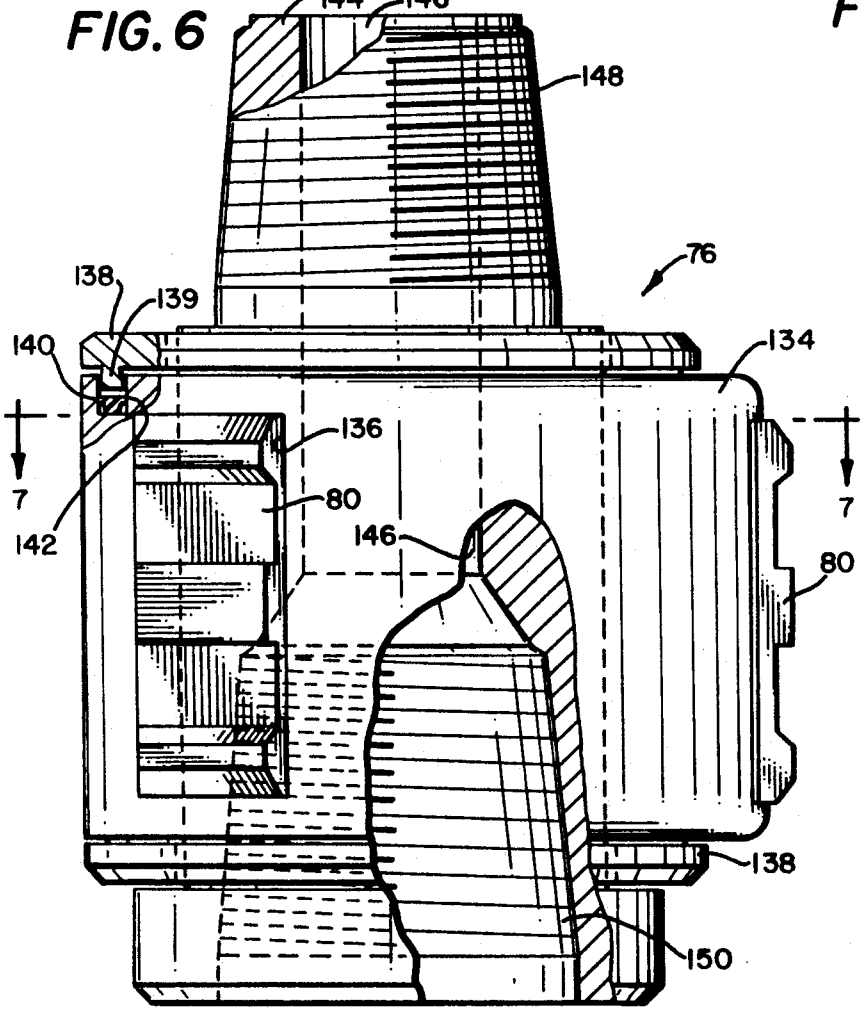
FIG. 6 is an enlarged elevation view, partially broken away, of the shift head assembly of the invention.

The structure and operation of shift head assembly 76 is further described and explained in relation to FIGS. 6 and 7. Shift head assembly 76 preferably comprises key housing 134 having a plurality of circumferentially spaced windows 136 containing shift keys 80 that are biased radially outward by key springs 156. According to a preferred embodiment of the invention, three shift keys 80 are provided at an angular spacing of 120 degrees around key housing 134, although it will be appreciated that four or more shift keys can be used within the scope of the invention. Fewer than three shift keys can also be used, but in such instances shift keys having a greater arcuate span and circumferentially spaced key springs are desirable to better distribute the mechanical load and avoid hang-ups.

The maximum diameter of key housing 134 is preferably slightly less than the inside diameter of flow sleeve 40. Windows 136 and shift keys 80 are preferably designed so that shift keys 80 are biased radially outward through windows 136 by key springs 156 a sufficient distance to engage upper and lower annular recesses 66, 68 of flow sleeve 40 when passing therethrough. Shift keys 80 are also adapted to be forced radially inward to a point flush with or slightly inside the outside diameter of key housing 134 to reduce wear and avoid hang-up that might otherwise occur. Key springs 156 are preferably retained inside radially extending cylindrical recesses 158 in keys 80 by sleeve 160. Although not visible in FIGS. 6 and 7, each shift key 80 preferably comprises two key springs 156 disposed in cylindrical recesses 158 that are parallel and vertically spaced. The use of a plurality of vertically spaced key springs 156 for each shift key 80 enables the key to "float" to some extent, and facilitates engagement with and disengagement from flow sleeve 40.

Key housing 134 is typically mounted on bit sub 144 having externally and internally threaded ends 148, 150, respectively, using a rubber Cutless® bearing 152 of the type manufactured by Uniroyal/Goodrich and well known to those of ordinary skill in the art. The use of a bearing such as a Cutless® bearing is desirable to prevent key housing 134 from rotating with the drill string or with the mud motor output shaft. If permitted, such rotation would quickly cause undesirable wear to shift keys 80 and key housing 134. As shown in FIG. 7, Cutless® bearing 152 is lubricated by drilling fluid that flows radially outward from flow channel 146 through bleed orifice 154.

When shift head assembly 76 is used with a bent sub, as is frequently the case in the "steered drilling" of a horizontal well, key housing 134 is likely to be canted slightly, such as from about ½ to about 1 degree, when it passes through flow sleeve 40 of flapper valve assembly 34. To help insure that the mechanical load on shift keys 80 is evenly distributed, load equalizer plates 138 are preferably provided at each end of key housing 134. Each load equalizer plate 138 preferably comprises an annular boss 139 that bears on a relatively soft O-ring 140 disposed in annular groove 142. As shift head assembly 76 engages flow sleeve 40, load equalizer plates 138 remain normal to the bit centerline, but O-rings 140 allow key housing 134 to cant slightly (such as from about ½ to about 1 degree) to allow shift keys 80 to align longitudinally with flow sleeve 40. This distributes the load more evenly to circumferentially spaced shift keys 80.

While the apparatus of the invention is described herein in relation to its preferred embodiment, it will be appreciated that the flapper valve assembly disclosed herein is applicable to downhole uses other than as a casing shut-in valve, such as for example, in a surface controlled, subsurface safety valve where the flapper is closed by a piston actuated by hydraulic pressure. Other alterations and modifications of the apparatus disclosed herein will likewise become apparent to those of ordinary skill in the art upon reading this disclosure, and it is intended that the scope of the invention be limited only by the broadest interpretation of the appended claims to which the inventor is legally entitled.

I claim:

1. A valve for use within a conduit in a subterranean well, the valve comprising a valve seat, a valve closure member adapted to rotate reversibly about a hinge point between open and closed positions through an included angle of less than 90 degrees, and means for selectively controlling movement of the valve closure member reversibly between the open and closed positions, said control means comprising means for biasing the valve closure member toward the closed position, said biasing means comprising a plurality of spring strut assemblies rotatably connected to the valve closure member, with at least one strut assembly being rotatably connected to the valve closure member on each side of the hinge point of the valve closure member.

2. A valve system for use within a conduit in a subterranan well, the valve system comprising a valve assembly and a shift head assembly;

the valve assembly comprising a substantially cylindrical body, a valve seat, a valve closure member adapted to rotate reversibly about a hinge connected to the body between open and closed positions through an included angle of less than 90 degrees, means for biasing the valve closure member toward the closed position, said means comprising a plurality of strut assemblies rotatably connected to the valve closure member at circumferentially spaced points, with at least one strut assembly being disposed on each side of the hinge of the valve closure member, and a sleeve member adapted to slide reversibly between first and second positions inside the body corresponding respectively to the open and closed positions of the valve closure member;

the shift head assembly comprising means for releasably engaging the sleeve member for selectively moving the sleeve member between the first and second positions.

3. The valve system of claim 2, wherein the strut assemblies are rotatably connected to the valve closure member at circumferentially spaced points that are longitudinally spaced apart from the hinge of the valve closure member.

4. The valve system of claim 2, wherein each strut assembly comprises a guide member and a hinge support member that are slidably engaged, the guide member being rotatably connected to the body of the valve assembly and the hinge support member being rotatably connected to the valve closure member; and means for biasing the hinge support member away from the guide member.

5. The valve system of claim 4, wherein the hinge support member of at least one strut assembly is rotatably connected to the valve closure member at a position that is radially inward of the hinge connecting the valve closure member to the body.

6. The valve system of claim 4 wherein the hinge support member of at least one strut assembly is rotatably connected to the valve closure member at a position that is radially inward of the position where the strut assembly is rotatably connected to the body.

7. The valve system of claim 4 wherein the means for biasing the hinge support member away from the guide member is a spring.

8. The valve system of claim 2 wherein the arcuate sealing surface of the valve closure member comprises an elastomeric seal.

9. A valve system for use within a conduit in a subterranean well, the valve system comprising a valve assembly and a shift head assembly;

the valve assembly comprising a substantially cylindrical body, a valve seat, a valve closure member adapted to rotate reversibly about a hinge connected to the body between open and closed positions through an included angle of less than 90 degrees, means for biasing the valve closure member toward the closed position, and a sleeve member adapted to slide reversibly between first and second positions inside the body corresponding respectively to the open and closed positions of the valve closure member;

the body further comprising a longitudinal bore, detent means within the bore, and an annular recess in the body that is adapted to support the detent means within the bore, the detent means being adapted to releasably engage the sleeve member; and the shift head assembly comprising means for releasably engaging the sleeve member for selectively moving the sleeve member between the first and second positions.

10. A valve system for use within a conduit in a subterranean well, the valve system comprising a valve assembly and a shift head assembly;

the valve assembly comprising a substantially cylindrical body, a valve seat, a valve closure member adapted to rotate reversibly about a hinge connected to the body between open and closed positions through an included angle of less than 90 degrees, means for biasing the valve closure member toward the closed position, and a sleeve member adapted to slide reversibly between first and second positions inside the body corresponding respectively to the open and closed positions of the valve closure member;

the body further comprising a longitudinal bore and detent means within the bore, the detent means comprising circumferentially spaced bow springs and detent members that extend radially inward from the bow springs, the detent means being adapted to releasably engage the sleeve member;

the shift head assembly comprising means for releasably engaging the sleeve member for selectively moving the sleeve member between the first and second positions.

11. A valve system for use within a conduit in a subterranean well, the valve system comprising a valve assembly and a shit head assembly;

the valve assembly comprising a substantially cylindrical body, a valve seat, a valve closure member adapted to rotate reversibly about a hinge connected to the body between open and closed positions through an included angle of less than 90 degrees, means for biasing the valve closure member toward the closed position, and a sleeve member adapted to slide reversibly between first and second positions inside the body corresponding respectively to the open and closed positions of the valve closure member, the sleeve member comprising a substantially cylindrical outside wall having at least two longitudinally spaced annular recesses in the outside wall that are adapted to receive the detent means;

the shift head assembly comprising means for releasably engaging the sleeve member for selectively moving the sleeve member between the first and second positions.

12. A valve system for use within a conduit in a subterranean well, the valve system comprising a valve assembly and a shit head assembly;

the valve assembly comprising a substantially cylindrical body, a valve seat, a valve closure member adapted to rotate reversibly about a hinge connected to the body between open and closed positions through an included angle of less than 90 degrees, means for biasing the valve closure member toward the closed position, and a sleeve member adapted to slide reversibly between first and second positions inside the body corresponding respectively to the open and closed positions of the valve closure member;

the shift head assembly comprising means for releasably engaging the sleeve member for selectively moving the sleeve member between the first and second positions, a substantially cylindrical shift key housing having a plurality of windows circumferentially spaced around said housing, and a plurality of shift keys biased radially outward through the windows.

13. The valve system of claim 13 wherein each shift key is biased radially outward by at least one key spring.

14. The valve system of claim 13 wherein each shift key is biased radially outward by a plurality of longitudinally spaced, radially extending key springs.

15. The valve system of claim 12 wherein the shift head assembly comprises means for coaxially aligning the shift key housing with the sleeve member.

16. The valve system of claim 15 wherein the shift head assembly comprises a load equalizer plate at each end of the shift key housing.

17. The valve system of claim 12 wherein a tubular conduit extends longitudinally through the shift key housing and is rotatably mounted therein.

18. The valve system of claim 12 wherein the tubular conduit is rotatably mounted inside a Cutless ® bearing disposed inside the shift key housing.

19. The valve system of claim 17 wherein the sleeve member comprises a substantially cylindrical inside wall having at least two longitudinally spaced annular recesses adapted to receive the shift keys for movement of the sleeve member between the first and second positions.

20. The valve system of claim 19 wherein each annular recess in the inside wall of the sleeve member comprises one square shoulder and one beveled shoulder, with each square shoulder being disposed nearer to the closest end of the sleeve than the respective beveled shoulder.

21. The valve system of claim 12 wherein the body comprises a longitudinally extending bore having a beveled shoulder at each end thereof, and each shift key comprises a beveled surface adapted to contact and slide against the beveled shoulder to release the shift key from the sleeve member.

* * * * *